US005469243A

United States Patent [19]

Saitoh et al.

[11] Patent Number: 5,469,243

[45] Date of Patent: Nov. 21, 1995

[54] IMAGE FORMING APPARATUS HAVING A FUNCTION TO CHARGE AT A LOW MAIN CHARGING VOLTAGE

[75] Inventors: Yasushi Saitoh; Masashi Matsumoto; Takao Ichihashi; Shuji Yamada, all of Osaka, Japan

[73] Assignee: Mita Industrial Co., Ltd., Osaka, Japan

[21] Appl. No.: 213,532

[22] Filed: Mar. 16, 1994

[30] Foreign Application Priority Data

Mar. 23, 1993 [JP] Japan ..... 5-062376

[51] Int. Cl.[6] ..... G03G 15/00

[52] U.S. Cl. ..... 355/225; 355/208; 355/219

[58] Field of Search ..... 355/246, 208, 355/214, 219, 216, 225; 358/500, 300; 361/221–225

[56] References Cited

U.S. PATENT DOCUMENTS

| | | | |
|---|---|---|---|
| 3,688,107 | 8/1972 | Schneider et al. | 250/324 |
| 4,277,549 | 7/1981 | Tatsumi et al. | 430/30 |
| 4,564,287 | 1/1986 | Suzuki et al. | 355/208 |
| 4,811,045 | 3/1989 | Matsushita et al. | 355/219 |
| 5,164,776 | 11/1992 | Oresick et al. | 355/208 |
| 5,212,560 | 5/1993 | Hattori et al. | 358/360 |
| 5,270,660 | 12/1993 | Werner, Jr. et al. | 324/457 |
| 5,274,424 | 12/1993 | Hattori et al. | 355/208 |

*Primary Examiner*—A. T. Grimley
*Assistant Examiner*—T. A. Dang
*Attorney, Agent, or Firm*—Beveridge, DeGrandi, Weilacher & Young

[57] ABSTRACT

For an image forming apparatus having a photoreceptor whose surface is charged by a main charger unit, a function is provided that a desired electric potential is attained on the photoreceptor surface by applying a lowest main charging voltage to the charger unit. By providing a plurality of grid voltages, it is possible that there are a plurality of main charging voltages suitable for the desired surface potential, and the lowest main charging voltage and the corresponding grid voltage can be selected thereamong.

6 Claims, 3 Drawing Sheets

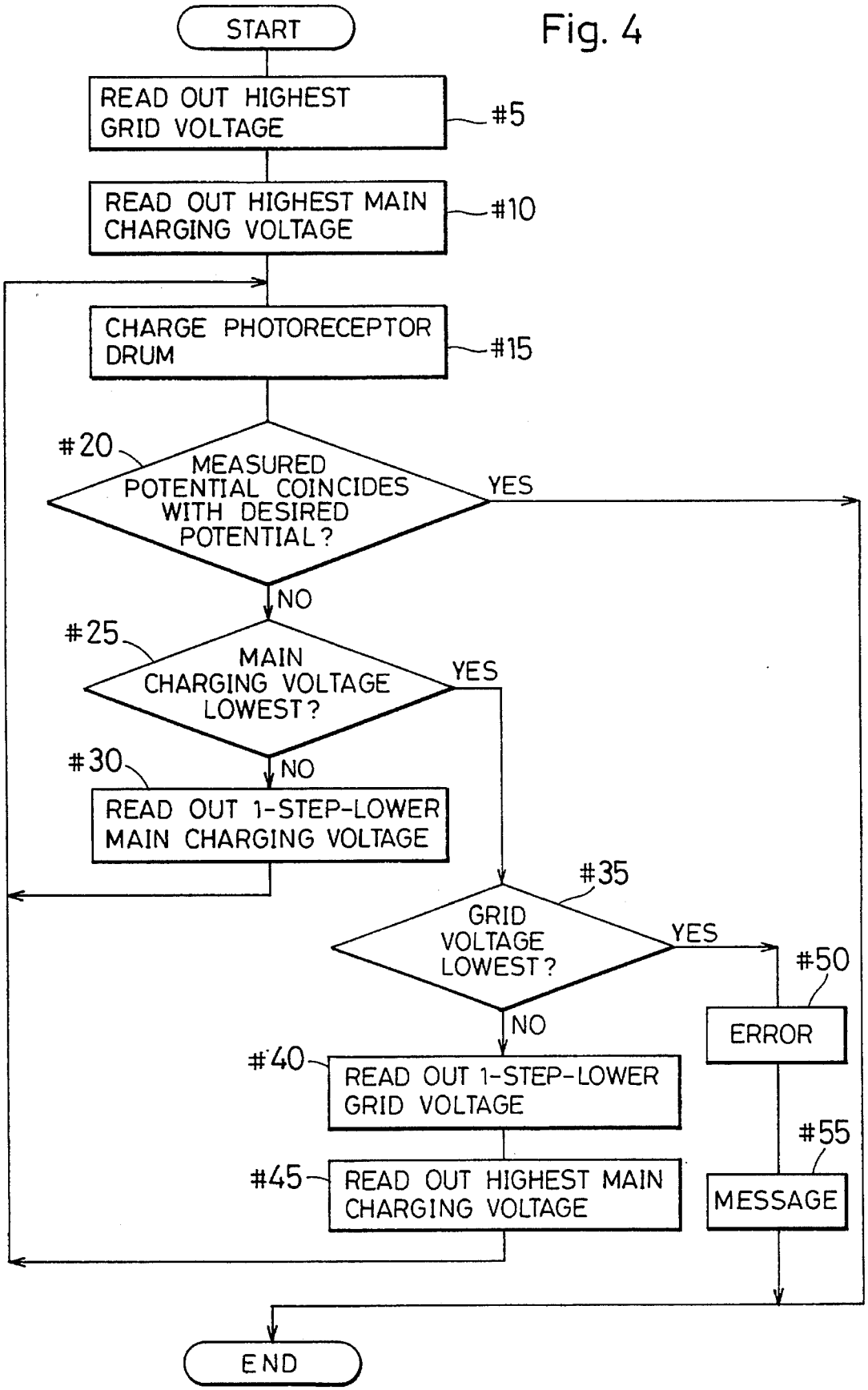
Fig. 4
START
READ OUT HIGHEST GRID VOLTAGE
#5
READ OUT HIGHEST MAIN CHARGING VOLTAGE
#10
CHARGE PHOTORECEPTOR DRUM
#15
#20
MEASURED POTENTIAL COINCIDES WITH DESIRED POTENTIAL?
YES
NO
#25
MAIN CHARGING VOLTAGE LOWEST?
YES
NO
#30
READ OUT 1-STEP-LOWER MAIN CHARGING VOLTAGE
#35
GRID VOLTAGE LOWEST?
YES
NO
#50
ERROR
#40
READ OUT 1-STEP-LOWER GRID VOLTAGE
#55
#45
READ OUT HIGHEST MAIN CHARGING VOLTAGE
MESSAGE
END

IMAGE FORMING APPARATUS HAVING A FUNCTION TO CHARGE AT A LOW MAIN CHARGING VOLTAGE

BACKGROUND OF THE INVENTION

1. Field of the Invention

The present invention relates to an image forming apparatus such as an electrophotographic copying machine and a printer in which the surface of a photoreceptor drum is charged by a main charger unit, and more particularly, to an image forming apparatus having a function to maintain a main charging voltage of the main charger unit to be low.

2. Description of the Prior Art

In an image forming apparatus such as an electrophotographic copying machine and a laser beam printer, to form an electrostatic latent image on the surface of a photoreceptor drum by means of an exposing portion, the drum surface is charged in advance by a main charger unit of Scorotron type including a grid electrode and a high-voltage electrode for applying a main charging voltage. At the time of the charging, the grid voltage is fixed to a predetermined value, and the main charging voltage is varied so that a desired surface potential is obtained at a main charging voltage-to-photoreceptor drum surface potential characteristic at the grid voltage. However, in such a conventional surface potential controlling arrangement, since the main charging voltage-to-photoreceptor drum surface potential characteristics is fixed to one because of the fixed grid voltage, in order to obtain a high surface potential at the characteristic, it is necessary to apply a very high main charging voltage. However, it is difficult to supply such a high main charging voltage stably, and an environmental problem such as the generation of a large quantity of ozone is caused.

SUMMARY OF THE INVENTION

An object of the present invention is to provide an image forming apparatus with which, in charging the surface of a photoreceptor drum by means of a main charger unit, a desired surface potential is obtained at a lowest main charging voltage. To achieve this object, according to the present invention, in an image forming apparatus in which the surface of a photoreceptor drum is charged by a main charger unit including a grid electrode and a high-voltage electrode for applying a main charging voltage, a grid voltage is not fixed but an optimum one is selected among a plurality of grid voltages. Since a main charging voltage-to-photoreceptor drum surface potential characteristic is present for every grid voltage, a plurality of main charging voltages are present suitable for applying a desired potential to the surface of the photoreceptor drum, and a lowest one of them is selected. Specifically, the grid voltage is reduced from a high one and a main charging voltage at the grid voltage is varied from a high one to a low one to detect the potential of the photoreceptor drum surface. The grid voltage is reduced until a desired potential is obtained. Thereby, a lowest main charging voltage for charging the photoreceptor drum surface at a desired potential and a grid voltage corresponding to the lowest main charging voltage are obtained. This enables a stable charging.

BRIEF DESCRIPTION OF THE DRAWINGS

This and other objects and features of this invention will become clear from the following description, taken in conjunction with the preferred embodiments with reference to the accompanied drawings in which:

FIG. 4 is a flowchart of a control operation of the embodiment of the present invention.

DESCRIPTION OF THE PREFERRED EMBODIMENTS

Hereinafter, an electrophotographic copying machine embodying the present invention will be described with reference to the drawings.

Figure 1:
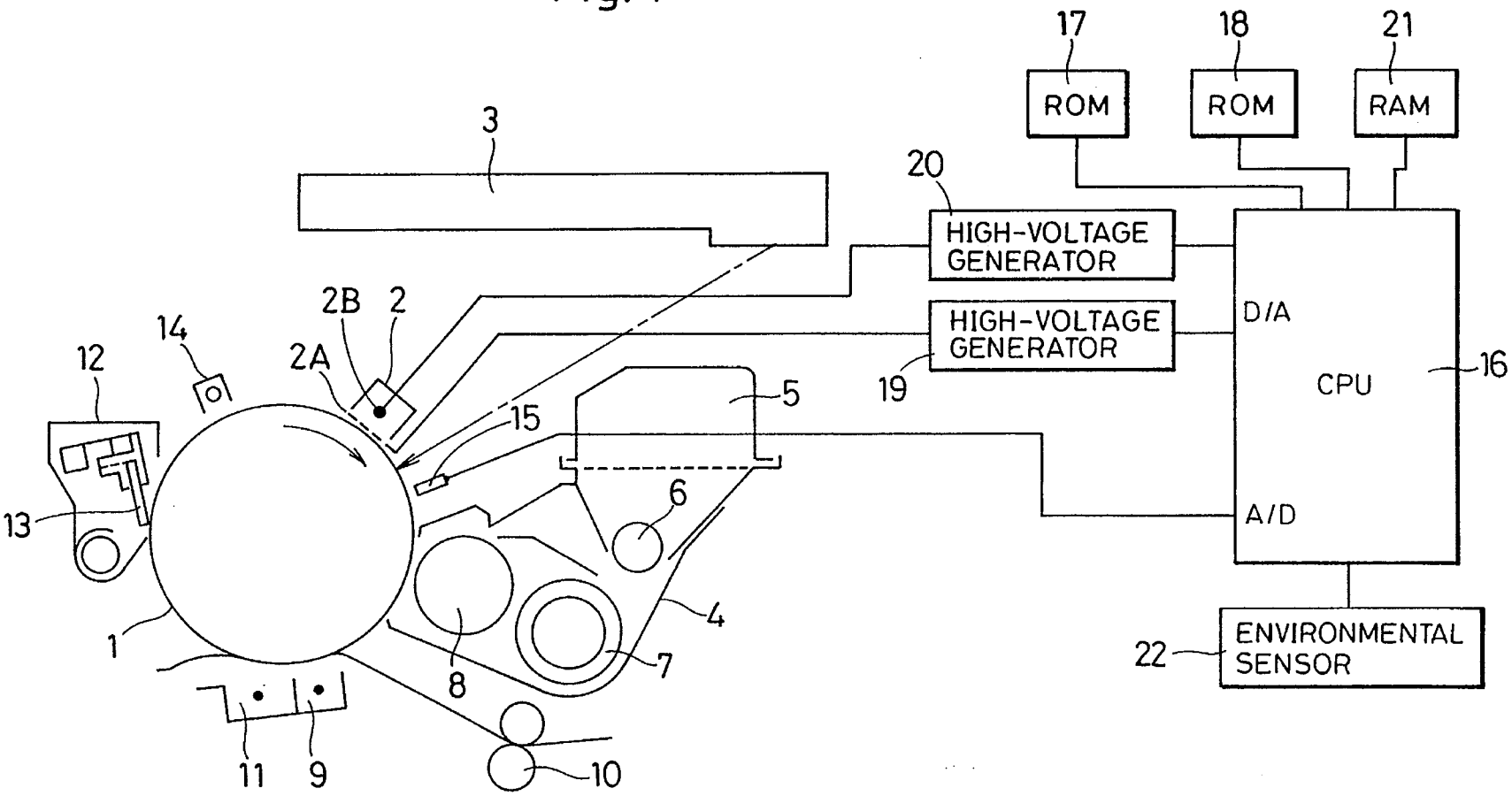
FIG. 1 is a schematic view of an electrophotographic copying machine embodying the present invention.

Referring to FIG. 1, there is schematically shown an arrangement of the copying machine. A photoreceptor drum 1 is rotated at a constant speed in a direction of the arrow by an operation of a copy start key. The photoreceptor drum 1 comprises a base drum made of, for example, an aluminum material on which a photosensitive selenic material capable of being charged excellently is deposited. Along the periphery of the photoreceptor drum 1, the following are provided in its rotation direction: a charging unit; an exposing unit; a developing unit; a transferring unit; a separating unit; a cleaning unit; and a charge-removing unit.

The surface of the photoreceptor drum 1 is uniformly charged by a main charger unit 2, which is provided with a grid electrode 2A and a high-voltage electrode 2B for applying a main charging voltage. The electric potential of the photoreceptor drum surface is controlled by the grid voltage and the main charging voltage. Generally, various combinations of the grid and main charging voltages are possible to generate the same charge potential. A laser unit 3 exposes the charged surface of the photoreceptor drum 1. The surface potential of the exposed portion decreases in correspondence with the exposure amount, thereby forming an electrostatic latent image. The latent image formed on the surface of the photoreceptor drum 1 is transformed into a toner image by a developer unit 4. Toner supplied from a toner hopper 5 through a supply roller 6 is mixed with carrier by a stirring roller 7 to form magnetic brushes made of carrier to which toner adheres on the surface of a developing roller 8. The magnetic brush is brought into contact with the surface of the photoreceptor drum 1 by rotating the developing roller 8, and toner is transported onto the surface in accordance with the electrostatic latent image, thereby forming a toner image. The toner forming the toner image is transferred by a transferring unit 9 onto a sheet fed through paper feeding rollers 10. After the transfer, a separating unit 11 dissolves the attraction relationship between the photoreceptor drum 1 and the sheet by applying an alternating current electric field to the surface of the drum 1, thereby separating the sheet on which the toner has been transferred from the drum 1. Residual toner and the charge on the surface of the photoreceptor drum 1 are removed by a blade 13 of a cleaning unit 12 made of rubber material and by light from a charge removing lamp of a charge removing unit 14, respectively.

In this apparatus, in order that a desired surface potential is obtained at a lowest main charging voltage, a potential sensor 15 and a microcomputer are provided. The potential sensor 15 is arranged between the exposing unit and the developing unit to detect a surface potential of the photoreceptor drum 1 which has not been exposed. The microcomputer includes a central processing unit (CPU) 16, a read only memory (ROM) 17 for program storage, a ROM 18 for data storage and a random access memory (RAM) 21 shown in FIG. 1. Based on a potential detected by the potential sensor 15, the CPU 16 varies the grid voltage and the main charging voltage. The ROM 17 stores a control program. The ROM 18 stores voltage data including a plurality of grid voltages and a plurality of main charging voltages with resect to each grid voltage.

Figure 2:
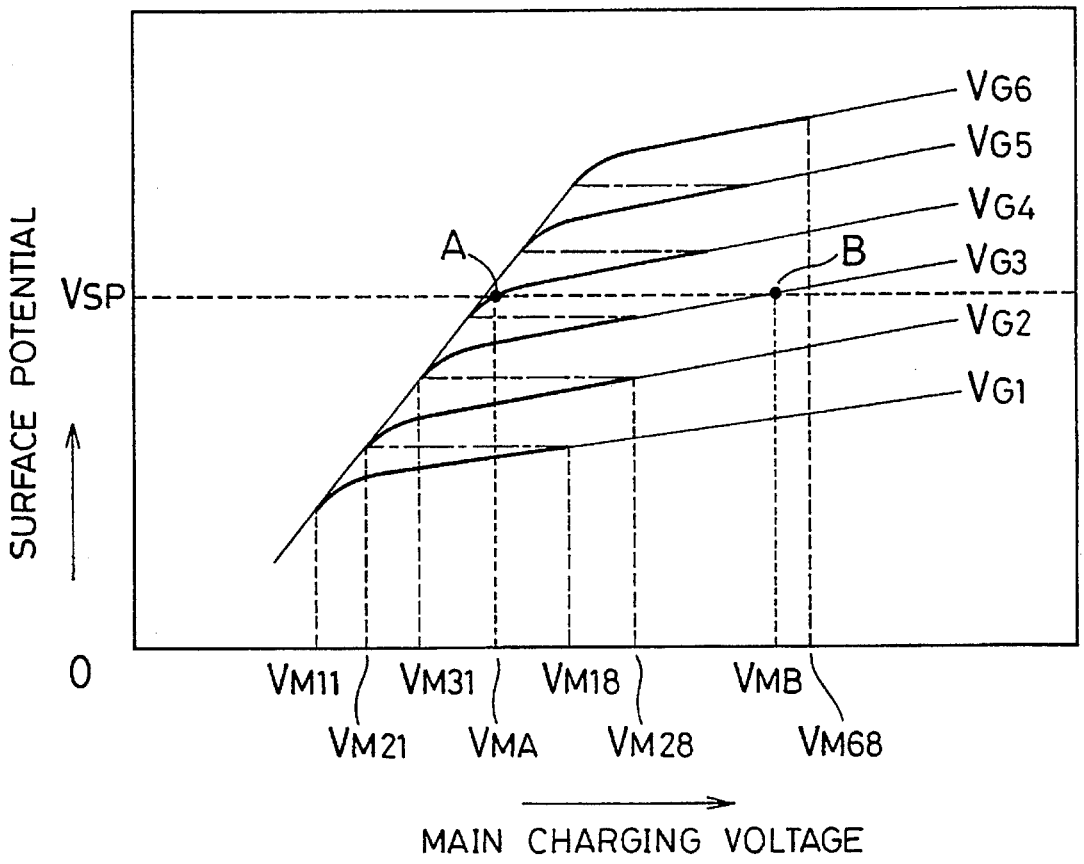
FIG. 2 shows main charging voltage-to-photoreceptor drum surface potential characteristics of the embodiment of the present invention.
Figure 3:
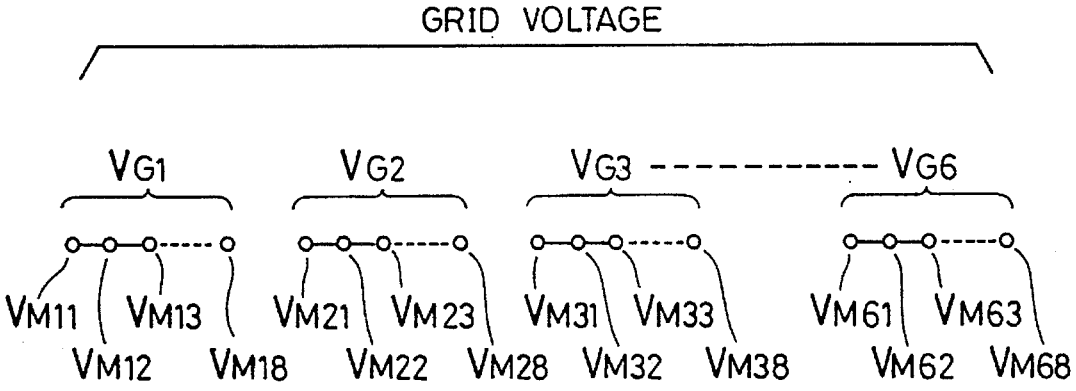
FIG. 3 shows variation ranges of main charging voltages corresponding to grid voltages of the embodiment of the present invention.

The main charging voltage-to-photoreceptor drum surface potential characteristic differs according to the grid voltage as shown in FIG. 2. The voltage data of this apparatus include six grid voltages $V_{G1}$ (low) to $V_{G6}$ (high) and main charging voltages, with respect to the grid voltages, at eight points within relatively low-voltage and linear ranges on the main charging voltage-to-photoreceptor drum surface potential characteristics, i.e. within the ranges shown by the thick lines in FIG. 2. The range of the main charging voltage differs for every grid voltage. As shown in FIG. 3, the main charging voltage can be varied from $V_{M11}$ to $V_{M18}$ at the grid voltage $V_{G1}$, and the main charging voltage can be varied from $V_{M21}$ to $V_{M28}$ at the grid voltage $V_{G2}$. Similarly, at each of the grid voltages $V_{G3}$ to $V_{G6}$, the main charging voltage can be varied in eight steps in a different range. The values of voltages $V_{M18}$ and $V_{M21}$, voltages $V_{M28}$ and $V_{M31}$, voltages $V_{M38}$ and $V_{M41}$, voltages $V_{M48}$ and $V_{M51}$ and voltages $V_{M58}$ and $V_{M61}$ are respectively set so that the photoreceptor drum surface is charged at the same potential. Thereby, continuity is maintained in the control of the surface potential by means of the grid and main charging voltages.

The voltage data are read out from the data ROM 18 by the CPU 16, and digital-to-analog-converted (D/A-converted) and transmitted to high-voltage generators 19 and 20. The high-voltage generators 19 and 20 apply the grid voltage and the main charging voltage to the grid electrode 2A and the high-voltage electrode 2B, respectively. The optimum charge potential on the photoreceptor drum surface varies according to environmental conditions. An optimum potential in an environment is obtained by the CPU 16 based on a result of a measurement by an environmental sensor 22 for measuring an environmental condition such as the temperature. The optimum potential is temporarily stored in the RAM 21 as a desired potential.

Subsequently, a control operation by the CPU 16 for obtaining the desired surface potential will be described with reference to the flowchart of FIG. 4. When a copy start key is operated, before the copy scanning, the CPU 16 starts the control operation based on the control program stored in the program ROM 17. At step #5, the highest grid voltage $V_{G6}$ of the six grid voltages is read out from the data ROM 18. At step #10, the highest main charging voltage $V_{M68}$ at the grid voltage $V_{G6}$ is read out.

At step #15, after D/A-converted, the grid voltage and the main charging voltage are outputted to the high-voltage generators 19 and 20 to charge the photoreceptor drum surface. The charge potential at this time is measured by the potential sensor 15 under a condition where the laser unit 3 is disabled, and at step #20, whether or not the potential coincides with the desired potential for the present environmental conditions within a permissible range is judged. The permissible range is predetermined in consideration of the number of steps of grid and main charging voltages. When they coincide, since the lowest main charging voltage is found, the control operation is finished to perform copy scanning by using the grid and main charging voltages at that time. When they do not coincide, the process proceeds to step #25, where whether the main charging voltage is the lowest for the grid voltage or not is judged. When it is not the lowest, the process proceeds to step #30, where the main charging voltage smaller by one step is read out from the ROM 18, and the process returns to step #15.

When it is judged at step #25 that the main charging voltage data is the lowest, the process proceeds to step #35, where whether the grid voltage is the lowest one of the six or not is judged. When the grid voltage is not the lowest, the process proceeds to step #40, where the grid voltage smaller by one step is read out from the data ROM 18. After the highest main charging voltage at the grid voltage is read out at step #45, the process returns to step #15.

Thus, when the copy start key is operated, by activating the plurality of main charging voltage-to-photoreceptor drum surface potential characteristics which differ depending on the grid voltage, successively from the one at the grid voltage $V_{G6}$ to the one at the grid voltage $V_{G1}$ until the potential detected by the potential sensor 15 coincides with the desired potential, a desired point is found out for realizing a desired surface potential at a lowest main charging voltage at the characteristic. Then, copy scanning is performed by using the grid and main charging voltages at the desired point.

When the grid voltage is fixed like a conventional method, for example, to $V_{G3}$ to realize a desired surface potential $V_{SP}$ only at that characteristic, it is necessary to use a very high main charging voltage $V_{MB}$ with a desired point B. However, by activating a plurality of characteristics which differ depending on the grid voltage like in this embodiment, a desired point A occurs at the characteristic of the grid voltage $V_{G4}$, and the desired surface potential $V_{SP}$ is realized at a relatively low main charging voltage $V_{MA}$.

When it is judged at step #35 that the grid voltage is the lowest one, the process proceeds to step #50, where it is determined that no desired point for realizing the desired surface potential is found at any characteristic, i.e., that error occurs. Then, a warning message such as a service man call is displayed at step #55, and the control operation ends.

While in this embodiment, the characteristics are successively activated from the one at the grid voltage $V_{G6}$ to the one at the grid voltage $V_{G1}$, the order of activation may be reverse. In that case, however, the judging process to find the lowest main charging voltage will be complicated. Moreover, while in this embodiment, the grid voltage is varied in six steps from $V_{G1}$ to $V_{G6}$ and the main charging voltage is varied in eight steps at each grid voltage, the present invention is not limited thereto.

When the desired potential obtained based on a result of the measurement by the environmental sensor 22 is the same as the potential in the previous image formation, the photoreceptor drum surface is charged by using the previously-used grid and main charging voltages without performing the above-described voltage control. A timer function may be provided so that the voltage control is performed only when an elapsed time since the previous image formation exceeds a predetermined period of time. The setting of the charge potential by this apparatus is effective, particularly when the image formation is resumed after a long intermission.

As described above, according to the present invention, in charging the surface of the photoreceptor drum by means of the main charger unit, a desired surface potential is obtained at a lowest main charging voltage. As a result, the main charging voltage is stabilized and the generation amount of ozone is reduced. Thus, the present invention is very effective for use in electrophotographic copying machines and printers.

Obviously, many modifications and variations of the present invention are possible in light of the above teachings. It is therefore to be understood that within the scope of the appended claims, the invention may be practiced other than as specifically described.

What is claimed is:

1. An image forming apparatus comprising:

a photoreceptor;

charging means having a grid electrode and a main charging electrode, for charging a surface of the photoreceptor;

potential detecting means for detecting a charge potential of the surface of the photoreceptor;

data storage means for storing voltage data including combinations of a plurality of grid voltages and a plurality of main charging voltages corresponding to each grid voltage; and controlling means for, prior to image formation, selecting out of the voltage data a combination for charging the surface of the photoreceptor at a desired charge potential with a lowest main charging voltage by repeating the charging and the potential detection until a detected potential coincides with the desired charge potential, a process in which the grid voltage is reduced successively from a highest grid voltage to a lowest grid voltage and at each grid voltage, the main charging voltage is reduced successively from a highest value to a lowest value at the grid voltage.

2. An image forming apparatus according to claim 1, wherein a highest main charging voltage at each grid voltage included in the voltage data is the same as a lowest main charging voltage at a grid voltage higher by one step than the grid voltage.

3. An image forming apparatus comprising a photoreceptor;

charging means having a grid electrode and a main charging electrode, for charging a surface of the photoreceptor;

potential detecting means for detecting a charge potential of the surface of the photoreceptor;

data storage means for storing voltage data including combinations of a plurality of grid voltages and a plurality of main charging voltages corresponding to each grid voltage;

controlling means for, prior to image formations, selecting out of the voltage data a combination for charging the surface of the photoreceptor at a desired charge potential with a lowest main charging voltage by repeating the charging and the potential detection, and timer means, wherein when an elapsed time since a previous image formation is within a predetermined period of time, the surface of the photoreceptor is charged by using a grid voltage and a main charging voltage used in the previous image formation.

4. An image forming apparatus comprising a photoreceptor;

charging means having a grid electrode and a main charging electrode, for charging a surface of the photoreceptor;

potential detecting means for detecting a charge potential of the surface of the photoreceptor;

data storage means for storing voltage data including combinations of a plurality of grid voltages and a plurality of main charging voltages corresponding to each grid voltage;

controlling means for, prior to image formation, selecting out of the voltage data a combination for charging the surface of the photoreceptor at a desired charge potential with a lowest main charging voltage by repeating the charging and the potential detection, and an environmental sensor, wherein the desired charge potential is determined based on an output from the environmental sensor.

5. An image forming apparatus according to claim 4, wherein said environmental sensor comprises a temperature sensor.

6. An image forming apparatus according to claim 4, further comprising storage means for storing the desired charge potential, wherein when the desired charge potential is the same as a desired charge potential of a previous image formation stored in the storage means, the surface of the photoreceptor is charged by using a grid voltage and a main charging voltage used in the previous image formation.

* * * * *